US010784578B2

(12) United States Patent
Chou

(10) Patent No.: US 10,784,578 B2
(45) Date of Patent: Sep. 22, 2020

(54) ANTENNA SYSTEM

(71) Applicant: Wistron Corp., New Taipei (TW)

(72) Inventor: Chen-Yu Chou, New Taipei (TW)

(73) Assignee: WISTRON CORP., New Taipei (TW)

( * ) Notice: Subject to any disclaimer, the term of this patent is extended or adjusted under 35 U.S.C. 154(b) by 46 days.

(21) Appl. No.: 16/186,434

(22) Filed: Nov. 9, 2018

(65) Prior Publication Data

US 2020/0106178 A1 Apr. 2, 2020

(30) Foreign Application Priority Data

Oct. 2, 2018 (TW) ..... 107134801 A

(51) Int. Cl.

| | |
|---|---|
| ***H01Q 21/00*** | (2006.01) |
| ***H01Q 5/20*** | (2015.01) |
| ***H01Q 1/22*** | (2006.01) |
| ***H01Q 1/24*** | (2006.01) |

(52) U.S. Cl.

CPC ..... *H01Q 5/20* (2015.01); *H01Q 1/2291* (2013.01); *H01Q 1/243* (2013.01); *H01Q 21/0006* (2013.01)

(58) Field of Classification Search

None

See application file for complete search history.

(56) References Cited

U.S. PATENT DOCUMENTS 6,975,834 B1 * 12/2005 Forster ..... G06K 19/0724 455/277.2
7,298,339 B1 * 11/2007 Ollikainen ..... H01Q 1/243 343/700 MS
7,541,984 B2 * 6/2009 Peng ..... H01Q 1/243 343/700 MS
8,482,471 B2 * 7/2013 Su ..... H01Q 7/00 343/700 MS
8,823,596 B2 * 9/2014 Chen ..... H01Q 13/10 343/702
2004/0046697 A1 * 3/2004 Tai ..... H01Q 1/243 343/700 MS
2004/0104853 A1 * 6/2004 Chen ..... G06F 1/1616 343/702
2010/0245191 A1 * 9/2010 Castaneda ..... H01Q 1/2266 343/722
2011/0215971 A1 9/2011 Rao
2012/0287012 A1 * 11/2012 Aizawa ..... H01Q 1/243 343/853
2014/0062795 A1 * 3/2014 Huang ..... H01Q 1/243 343/700 MS
2014/0191918 A1 * 7/2014 Cheng ..... H01Q 1/48 343/834
2015/0054706 A1 * 2/2015 Shimura ..... H01Q 1/50 343/843
2015/0188212 A1 * 7/2015 Tseng ..... H01Q 1/243 343/702
2016/0049736 A1 * 2/2016 Liu ..... H01Q 21/28 343/893
2017/0256854 A1 * 9/2017 Hu ..... H01Q 1/48

* cited by examiner

*Primary Examiner* — Trinh V Dinh

(57) ABSTRACT

An antenna system includes a first antenna, a second antenna, and a third antenna. The third antenna is disposed between the first antenna and the second antenna. Both the first antenna and the second antenna operate in a first frequency band. The third antenna operates in a second frequency band which is different from the first frequency band. The first antenna, the second antenna, and the third antenna are all disposed on the same plane.

17 Claims, 5 Drawing Sheets

ANTENNA SYSTEM

CROSS REFERENCE TO RELATED APPLICATIONS

This Application claims priority of Taiwan Patent Application No. 107134801 filed on Oct. 2, 2018, the entirety of which is incorporated by reference herein.

BACKGROUND OF THE INVENTION

Field of the Invention

The disclosure generally relates to an antenna system, and more particularly, to an antenna system for improving isolation.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna system is indispensable in a mobile device supporting wireless communication. However, since the interior space in a mobile device is very limited, multiple antennas are usually disposed close to each other, and such a design causes serious interference between antennas. As a result, there is a need to design a new antenna system for solving the problem of bad isolation in conventional antenna systems.

SUMMARY OF THE INVENTION

In an exemplary embodiment, the invention is directed to an antenna system including a first antenna, a second antenna, and a third antenna. The third antenna is disposed between the first antenna and the second antenna. Both the first antenna and the second antenna operate in a first frequency band. The third antenna operates in a second frequency band which is different from the first frequency band. The first antenna, the second antenna, and the third antenna are all disposed on the same plane.

In some embodiments, the distance between the first antenna and the third antenna is longer than or equal to 5 mm. The distance between the second antenna and the third antenna is longer than or equal to 5 mm.

In some embodiments, the first frequency band covers a first frequency interval from 2400 MHz to 2500 MHz and a second frequency interval from 4800 MHz to 6000 MHz. The second frequency band covers a third frequency interval from 680 MHz to 960 MHz, a fourth frequency interval from 1700 MHz to 2200 MHz, and a fifth frequency interval from 2500 MHz to 2700 MHz.

In some embodiments, the first antenna includes a first ground plane, a first feeding connection element, a first radiation element, and a first shorting element. The first feeding connection element has a first feeding point. The first radiation element is coupled to the first feeding connection element. The first feeding connection element is coupled through the first shorting element to the first ground plane.

In some embodiments, the first shorting element is surrounded by the first ground plane, the first feeding connection element, and the first radiation element.

In some embodiments, a combination of the first feeding connection element and the first radiation element substantially has an inverted U-shape.

In some embodiments, the first shorting element substantially has an inverted L-shape.

In some embodiments, the first feeding connection element, the first radiation element, and the first shorting element are excited to generate the first frequency interval. The first feeding connection element and the first shorting element are excited to generate the second frequency interval.

In some embodiments, the second antenna includes a second ground plane, a second feeding connection element, a second radiation element, and a second shorting element. The second feeding connection element has a second feeding point. The second radiation element is coupled to the second feeding connection element. The second feeding connection element is coupled through the second shorting element to the second ground plane.

In some embodiments, the second shorting element is surrounded by the second ground plane, the second feeding connection element, and the second radiation element.

In some embodiments, a combination of the second feeding connection element and the second radiation element substantially has an inverted U-shape.

In some embodiments, the second shorting element substantially has an inverted L-shape.

In some embodiments, the second feeding connection element, the second radiation element, and the second shorting element are excited to generate the first frequency interval. The second feeding connection element and the second shorting element are excited to generate the second frequency interval.

In some embodiments, the third antenna includes a third ground plane, a third feeding connection element, a third radiation element, a fourth radiation element, and a third shorting element. The third feeding connection element has a third feeding point. The third radiation element is coupled to the third feeding connection element. The fourth radiation element is coupled to the third feeding connection element. The third feeding connection element is coupled through the third shorting element to the third ground plane.

In some embodiments, the fourth radiation element is surrounded by the third feeding connection element, the third radiation element, and the third shorting element.

In some embodiments, the fourth radiation element further includes a terminal rectangular widening portion.

In some embodiments, the third radiation element substantially has an inverted U-shape.

In some embodiments, the third shorting element substantially has an inverted U-shape.

In some embodiments, the third feeding connection element, the third radiation element, and the third shorting element are excited to generate the third frequency interval. The third feeding connection element, the fourth radiation element, and the third shorting element are excited to generate the fourth frequency interval. The third feeding connection element and the third shorting element are excited to generate the fifth frequency interval.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
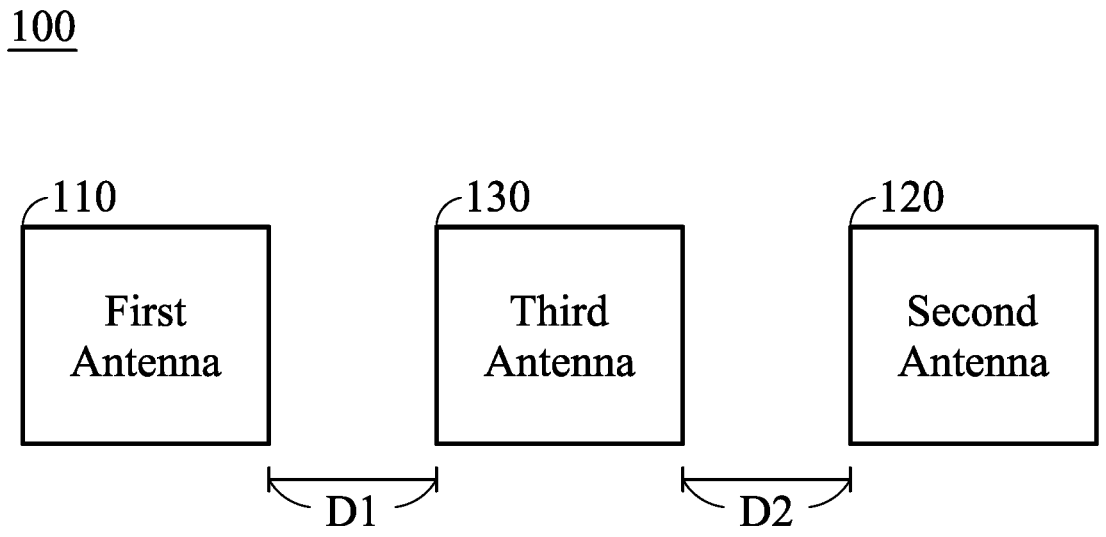
FIG. 1 is a diagram of an antenna system according to an embodiment of the invention.

FIG. 1 is a diagram of an antenna system 100 according to an embodiment of the invention. As shown in FIG. 1, the antenna system 100 includes a first antenna 110, a second antenna 120, and a third antenna 130. The third antenna 130 is substantially disposed between the first antenna 110 and the second antenna 120. In a preferred embodiment, both the first antenna 110 and the second antenna 120 operate in a first frequency band, and the third antenna 130 operates in a second frequency band which is entirely different from the first frequency band. For example, the first antenna 110, the second antenna 120, and the third antenna 130 may all be disposed on the same plane or may all be arranged in the same straight line. The distance D1 between the first antenna 110 and the third antenna 130 may be longer than or equal to 5 mm. The distance D2 between the second antenna 120 and the third antenna 130 may be longer than or equal to 5 mm. Since the third antenna 130 has a different resonant frequency, such a design can prevent the third antenna 130 from interfering with the first antenna 110 and the second antenna 120, so as to enhance the isolation between any two of the first antenna 110, the second antenna 120, and the third antenna 130. In addition, the total size of the antenna system 100 is further reduced by designing the third antenna 130 into a gap between the first antenna 110 and the second antenna 120.

In some embodiments, the aforementioned first frequency band is a WLAN (Wireless Local Area Network) band, and the aforementioned second frequency band is a WWAN (Wireless Wide Area Network) band. Specifically, the aforementioned first frequency band can cover a first frequency interval from 2400 MHz to 2500 MHz, and a second frequency interval from 4800 MHz to 6000 MHz, and the aforementioned second frequency band can cover a third frequency interval from 680 MHz to 960 MHz, a fourth frequency interval from 1700 MHz to 2200 MHz, and a fifth frequency interval from 2500 MHz to 2700 MHz. Accordingly, the antenna system 100 can support at least the wideband operations of WLAN and WWAN, but it is not limited thereto.

The following embodiments will introduce the detailed structure of the antenna system 100. It should be understood that these figures and descriptions are merely exemplary, rather than limitations of the invention.

Figure 2:
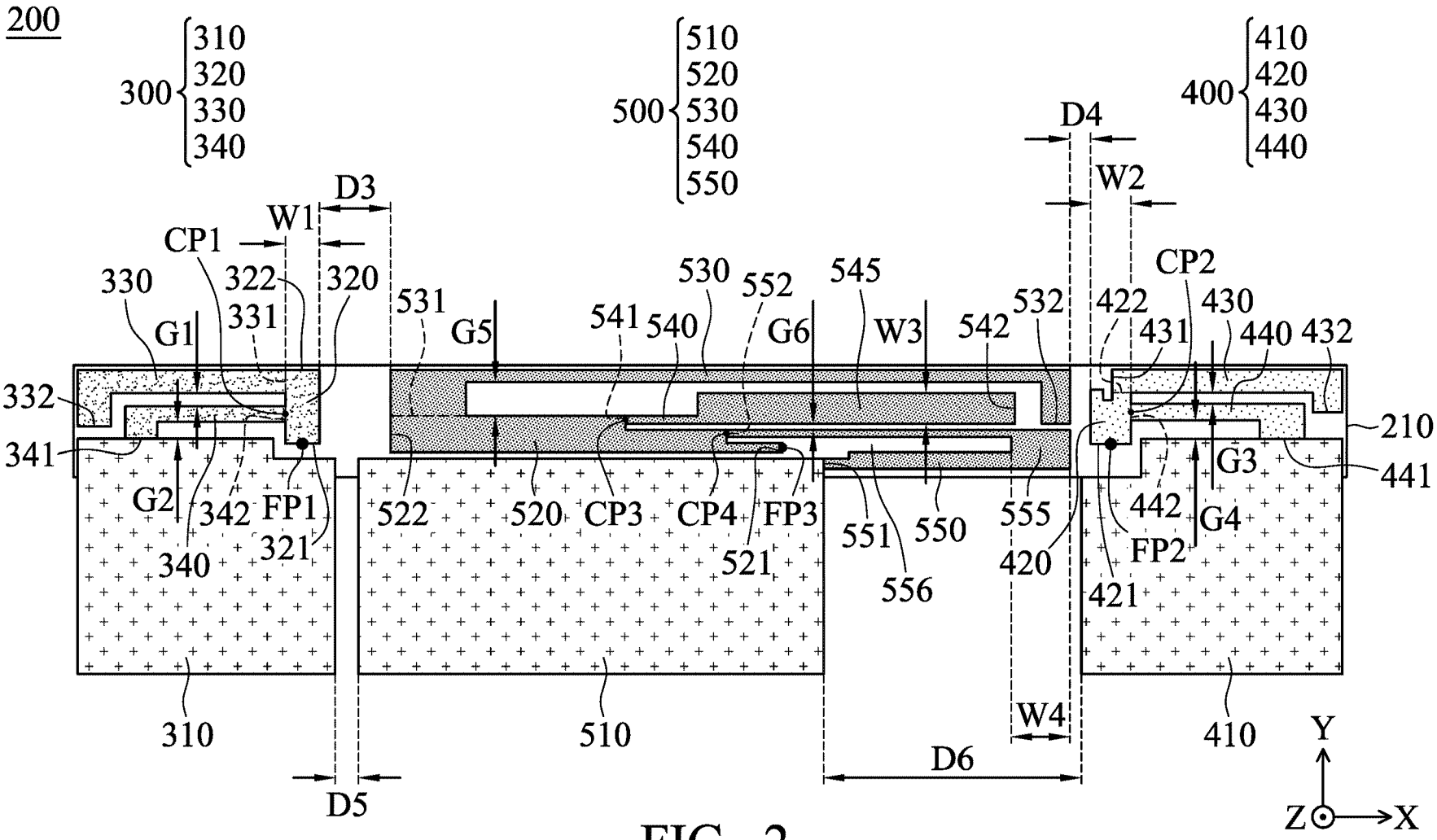
FIG. 2 is a diagram of an antenna system according to an embodiment of the invention.

FIG. 2 is a diagram of an antenna system 200 according to an embodiment of the invention. As shown in FIG. 2, the antenna system 200 includes a first antenna 300, a second antenna 400, and a third antenna 500. The third antenna 500 is disposed between the first antenna 300 and the second antenna 400. Both the first antenna 300 and the second antenna 400 can operate in the aforementioned first frequency band (e.g., the WLAN band). The third antenna 500 can operate in the aforementioned second frequency band (e.g., the WWAN band). In some embodiments, the antenna system 200 further includes a dielectric substrate 210, such as an FR4 (Flame Retardant 4) substrate, a PCB (Printed Circuit Board), or an FCB (Flexible Circuit Board). The first antenna 300, the second antenna 400, and the third antenna 500 are at least partially disposed on the dielectric substrate 210.

The first antenna 300 includes a first ground plane 310, a first feeding connection element 320, a first radiation element 330, and a first shorting element 340. All of the above elements of the first antenna 300 may be made of metal materials. The first ground plane 310 may be a ground copper foil extending onto the dielectric substrate 210. The first feeding connection element 320, the first radiation element 330, and the first shorting element 340 are all disposed on the dielectric substrate 210. The first feeding connection element 320 may substantially have a rectangular shape. The first feeding connection element 320 has a first end 321 and a second end 322. A first feeding point FP1 is positioned at the first end 321 of the first feeding connection element 320. The first feeding point FP1 may be coupled to a first signal source (not shown). For example, the first signal source may be a first RF (Radio Frequency) module for exciting the first antenna 300. The first radiation element 330 may substantially have an inverted L-shape. A combination of the first feeding connection element 320 and the first radiation element 330 may substantially have an inverted U-shape. The first radiation element 330 has a first end 331 and a second end 332. The first end 331 of the first radiation element 330 is coupled to the second end 322 of the first feeding connection element 320. The second end 332 of the first radiation element 330 is an open end extending toward the first ground plane 310. The first shorting element 340 may substantially have an inverted L-shape. The first shorting element 340 has a first end 341 and a second end 342. The first end 341 of the first shorting element 340 is coupled to the first ground plane 310, and the second end 342 of the first shorting element 340 is coupled to a first connection point CP1 on the first feeding connection element 320, such that the first feeding connection element 320 is coupled through the first shorting element 340 to the first ground plane 310. The first shorting element 340 is surrounded by the first ground plane 310, the first feeding connection element 320, and the first radiation element 330. A first gap G1 is formed between the first radiation element 330 and the first shorting element 340. A second gap G2 is formed between the first shorting element 340 and the first ground plane 310. The width of the second gap G2 is longer than the width of the first gap G1. In addition, the width W1 of the first feeding connection element 320 is longer than the width of the first radiation element 330, and is also longer than the width of the first shorting element 340. Such a design can increase the high-frequency operation bandwidth of the first antenna 300.

The operation principle and element sizes of the first antenna 300 may be described as follows. The first feeding connection element 320, the first radiation element 330, and the first shorting element 340 are excited to generate the aforementioned first frequency interval (e.g., from 2400 MHz to 2500 MHz). The first feeding connection element 320 and the first shorting element 340 are excited to generate the aforementioned second frequency interval (e.g., from 4800 MHz to 6000 MHz). The total length of the first feeding connection element 320, the first radiation element 330, and the first shorting element 340 (e.g., the total length from the first end 341 through the first connection point CP1 and the first end 331 to the second end 332) may be substantially equal to 0.25 wavelength (λ/4) of the central frequency of the first frequency interval. The total length of the first feeding connection element 320 and the first shorting element 340 (e.g., the total length from the first end 341 through the first connection point CP1 to the second end 322) may be substantially equal to 0.25 wavelength (λ/4) of the central frequency of the second frequency interval. The width W1 of the first feeding connection element 320 may be from 2.9 mm to 3.5 mm (e.g., 3.2 mm). The width of the first gap G1 may be from 1.3 mm to 1.7 mm (e.g., 1.5 mm). The width of the second gap G2 may be from 1.5 mm to 2.3 mm (e.g., 1.9 mm). The above ranges of elements are calculated and obtained according to many experimental results, and they help to optimize the operation bandwidth and impedance matching of the first antenna 300.

The second antenna 400 includes a second ground plane 410, a second feeding connection element 420, a second radiation element 430, and a second shorting element 440. All of the above elements of the second antenna 400 may be made of metal materials. The second ground plane 410 may be a ground copper foil extending onto the dielectric substrate 210. The second feeding connection element 420, the second radiation element 430, and the second shorting element 440 are all disposed on the dielectric substrate 210. The second feeding connection element 420 may substantially have a U-shape, an H-shape, or a rectangular shape. The second feeding connection element 420 has a first end 421 and a second end 422. A second feeding point FP2 is positioned at the first end 421 of the second feeding connection element 420. The second feeding point FP2 may be coupled to a second signal source (not shown). For example, the second signal source may be a second RF module for exciting the second antenna 400. The second radiation element 430 may substantially have an inverted L-shape. A combination of the second feeding connection element 420 and the second radiation element 430 may substantially have an inverted U-shape. The second radiation element 430 has a first end 431 and a second end 432. The first end 431 of the second radiation element 430 is coupled to the second end 422 of the second feeding connection element 420. The second end 432 of the second radiation element 430 is an open end extending toward the second ground plane 410. The second shorting element 440 may substantially have an inverted L-shape. The second shorting element 440 has a first end 441 and a second end 442. The first end 441 of the second shorting element 440 is coupled to the second ground plane 410, and the second end 442 of the second shorting element 440 is coupled to a second connection point CP2 on the second feeding connection element 420, such that the second feeding connection element 420 is coupled through the second shorting element 440 to the second ground plane 410. The second shorting element 440 is surrounded by the second ground plane 410, the second feeding connection element 420, and the second radiation element 430. A third gap G3 is formed between the second radiation element 430 and the second shorting element 440. A fourth gap G4 is formed between the second shorting element 440 and the second ground plane 410. The width of the fourth gap G4 is longer than the width of the third gap G3. In addition, the width W2 of the second feeding connection element 420 is longer than the width of the second radiation element 430, and is also longer than the width of the second shorting element 440. Such a design can increase the high-frequency operation bandwidth of the second antenna 400.

The operation principle and element sizes of the second antenna 400 may be described as follows. The second feeding connection element 420, the second radiation element 430, and the second shorting element 440 are excited to generate the aforementioned first frequency interval (e.g., from 2400 MHz to 2500 MHz). The second feeding connection element 420 and the second shorting element 440 are excited to generate the aforementioned second frequency interval (e.g., from 4800 MHz to 6000 MHz). The total length of the second feeding connection element 420, the second radiation element 430, and the second shorting element 440 (e.g., the total length from the first end 441 through the second connection point CP2 and the first end 431 to the second end 432) may be substantially equal to 0.25 wavelength (λ/4) of the central frequency of the first frequency interval. The total length of the second feeding connection element 420 and the second shorting element 440 (e.g., the total length from the first end 441 through the second connection point CP2 to the second end 422) may be substantially equal to 0.25 wavelength (λ/4) of the central frequency of the second frequency interval. The width W2 of the second feeding connection element 420 may be from 3.1 mm to 3.7 mm (e.g., 3.4 mm). The width of the third gap G3 may be from 1 mm to 1.4 mm (e.g., 1.2 mm). The width of the fourth gap G4 may be from 1.6 mm to 2.2 mm (e.g., 1.9 mm). The above ranges of elements are calculated and obtained according to many experimental results, and they help to optimize the operation bandwidth and impedance matching of the second antenna 400.

The third antenna 500 includes a third ground plane 510, a third feeding connection element 520, a third radiation element 530, a fourth radiation element 540, and a third shorting element 550. All of the above elements of the third antenna 500 may be made of metal materials. The third ground plane 510 may be a ground copper foil extending onto the dielectric substrate 210. The third feeding connection element 520, the third radiation element 530, the fourth radiation element 540, and the third shorting element 550 are all disposed on the dielectric substrate 210. The third feeding connection element 520 may substantially have a widthvarying straight-line shape. The third feeding connection element 520 has a first end 521 and a second end 522. The width of the second end 522 of the third feeding connection element 520 is longer than the width of the first end 521 of the third feeding connection element 520. A third feeding point FP3 is positioned at the first end 521 of the third feeding connection element 520. The third feeding point FP3 may be coupled to a third signal source (not shown). For example, the third signal source may be a third RF module for exciting the third antenna 500. The third radiation element 530 may substantially have an inverted U-shape. The third radiation element 530 has a first end 531 and a second end 532. The first end 531 of the third radiation element 530 is coupled to the end 522 of the third feeding connection element 520. The second end 532 of the third radiation element 530 is an open end extending toward the third shorting element 550. The width of the first end 531 of the third radiation element 530 may be longer than the width of the second end 532 of the third radiation element 530. The fourth radiation element 540 may substantially have a straight-line shape. The fourth radiation element 540 has a first end 541 and a second end 542. The first end 541 of the fourth radiation element 540 is coupled to a third connection point CP3 on the third feeding connection element 520. The second end 542 of the fourth radiation element 540 is an open end. In some embodiments, the fourth radiation element 540 further includes a terminal rectangular widening portion 545, such that the width W3 of the second end 542 of the fourth radiation element 540 is longer than the width of the first end 541 of the fourth radiation element 540. Such a design can increase the median-frequency operation bandwidth of the third antenna 500. The fourth radiation element 540 is surrounded by the third feeding connection element 520, the third radiation element 530, and the third shorting element 550. The third shorting element 550 may substantially have an inverted U-shape. The third feeding point FP3 may be positioned in a notch region 556 which is defined by the third shorting element 550. The third shorting element 550 has a first end 551 and a second end 552. The first end 551 of the third shorting element 550 is coupled to the third ground plane 510, and the second end 552 of the third shorting element 550 is coupled to a fourth connection point CP4 on the third feeding connection element 520, such that the third feeding connection element 520 is coupled through the third shorting element 550 to the third ground plane 510. In some embodiments, the third shorting element 550 further includes a median rectangular widening portion 555. The width W4 of the median rectangular widening portion 555 is longer than the width of the other portion of the third shorting element 550, so as to fine-tune the impedance matching of the third antenna 500. A fifth gap G5 is formed between the third radiation element 530 and the third feeding connection element 520. A sixth gap G6 is formed between the fourth radiation element 540 and the third shorting element 550. The width of the sixth gap G6 is longer than the width of the fifth gap G5.

The operation principle and element sizes of the third antenna 500 may be described as follows. The third feeding connection element 520, the third radiation element 530, and the third shorting element 550 are excited to generate the aforementioned third frequency interval (e.g., from 680 MHz to 960 MHz). The third feeding connection element 520, the fourth radiation element 540, and the third shorting element 550 are excited to generate the aforementioned fourth frequency interval (e.g., from 1700 MHz to 2200 MHz). The third feeding connection element 520 and the third shorting element 550 are excited to generate the aforementioned fifth frequency interval (e.g., from 2500 MHz to 2700 MHz). The total length of the third feeding connection element 520, the third radiation element 530, and the third shorting element 550 (e.g., the total length from the first end 551 through the fourth connection point CP4 and the first end 531 to the second end 532) may be substantially equal to 0.25 wavelength ($\lambda/4$) of the central frequency of the third frequency interval. The total length of the third feeding connection element 520, the fourth radiation element 540, and the third shorting element 550 (e.g., the total length from the first end 551 through the fourth connection point CP4 and the third connection point CP3 to the second end 542) may be substantially equal to 0.25 wavelength ($\lambda/4$) of the central frequency of the fourth frequency interval. The total length of the third feeding connection element 520 and the third shorting element 550 (e.g., the total length from the first end 551 through the fourth connection point CP4 to the second end 522) may be longer than or equal to 0.25 wavelength ($\lambda/4$) of the central frequency of the fifth frequency interval. The width W3 of the terminal rectangular widening portion 545 of the fourth radiation element 540 may be from 2.3 mm to 2.9 mm (e.g., 2.6 mm). The width W4 of the median rectangular widening portion 555 of the third shorting element 550 may be from 5 mm to 5.6 mm (e.g., 5.3 mm). The width of the fifth gap G5 may be from 2.9 mm to 3.5 mm (e.g., 3.2 mm). The width of the sixth gap G6 may be from 0.5 mm to 0.9 mm (e.g., 0.7 mm). The above ranges of the elements are calculated and obtained according to many experimental results, and they help to optimize the operation bandwidth and impedance matching of the third antenna 500.

In some embodiments, the main beam of the first antenna 300 is arranged toward a first direction (e.g., the direction of the −Y axis), the main beam of the second antenna 400 is arranged toward a second direction (e.g., the direction of the +X axis) which is perpendicular to the first direction, and the main beam of the third antenna 500 is arranged toward a third direction (e.g., the direction of the +Y axis) which is opposite to the first direction, so as to increase the spatial diversity gain of the antenna system 200. In order to increase the isolation between antennas, the distance D3 between the first antenna 300 and the third antenna 500 may be longer than or equal to 5 mm, and the distance D4 between the second antenna 400 and the third antenna 500 may be also longer than or equal to 5 mm. The distance D6 between the second ground plane 410 and the third ground plane 510 may be much longer than the distance D5 between the first ground plane 310 and the third ground plane 510. For example, the aforementioned distance D6 may be at least 5 times the aforementioned distance D5, thereby further reducing the interference between the second antenna 400 and the third antenna 500.

Figure 3A:
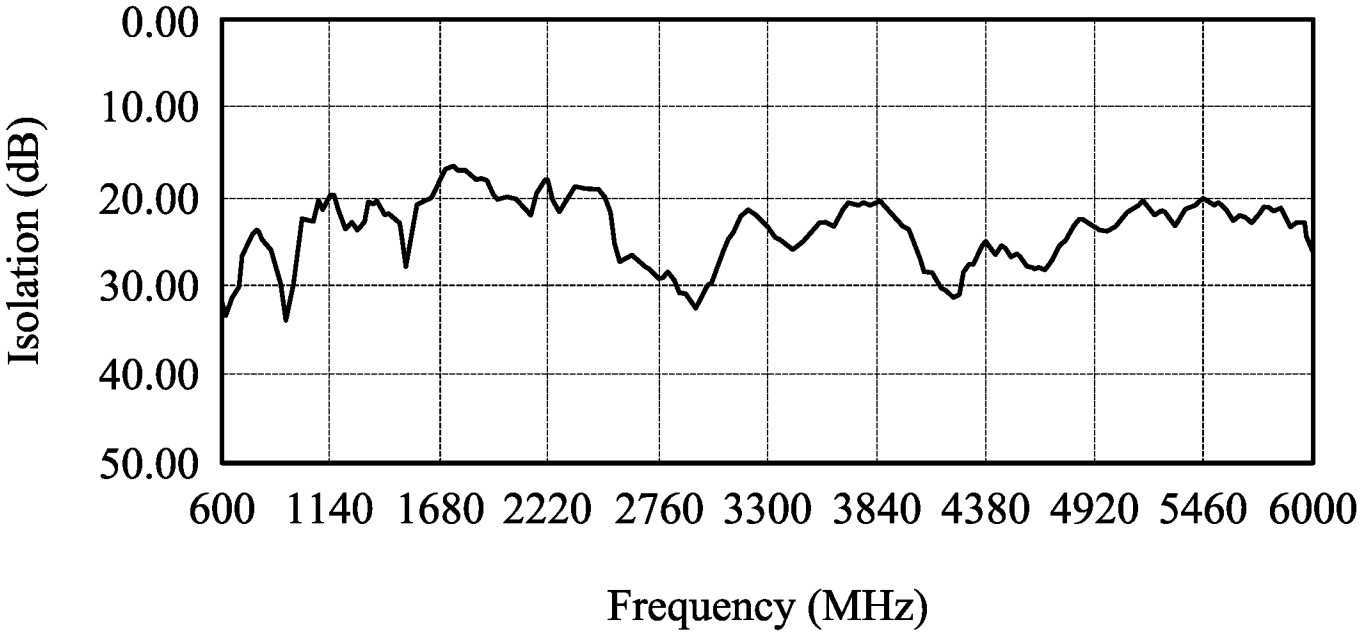
FIG. 3A is a diagram of isolation between a first antenna and a third antenna according to an embodiment of the invention.
Figure 3B:
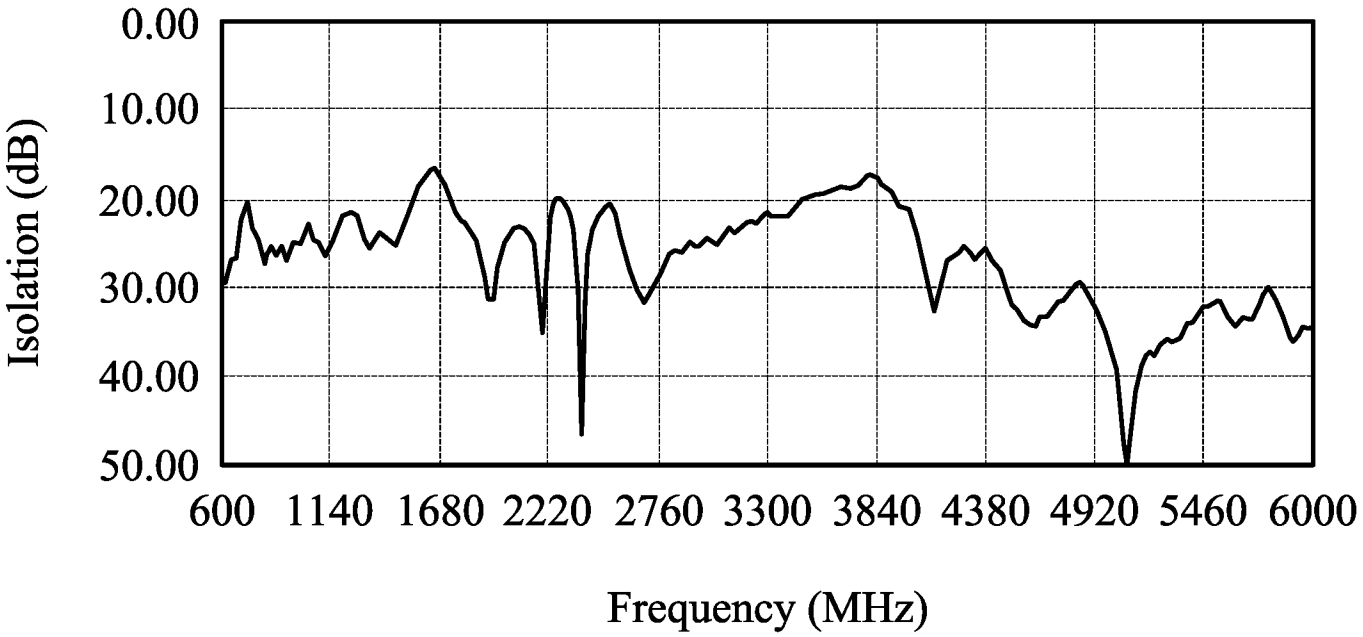
FIG. 3B is a diagram of isolation between a second antenna and a third antenna according to an embodiment of the invention.
Figure 3C:
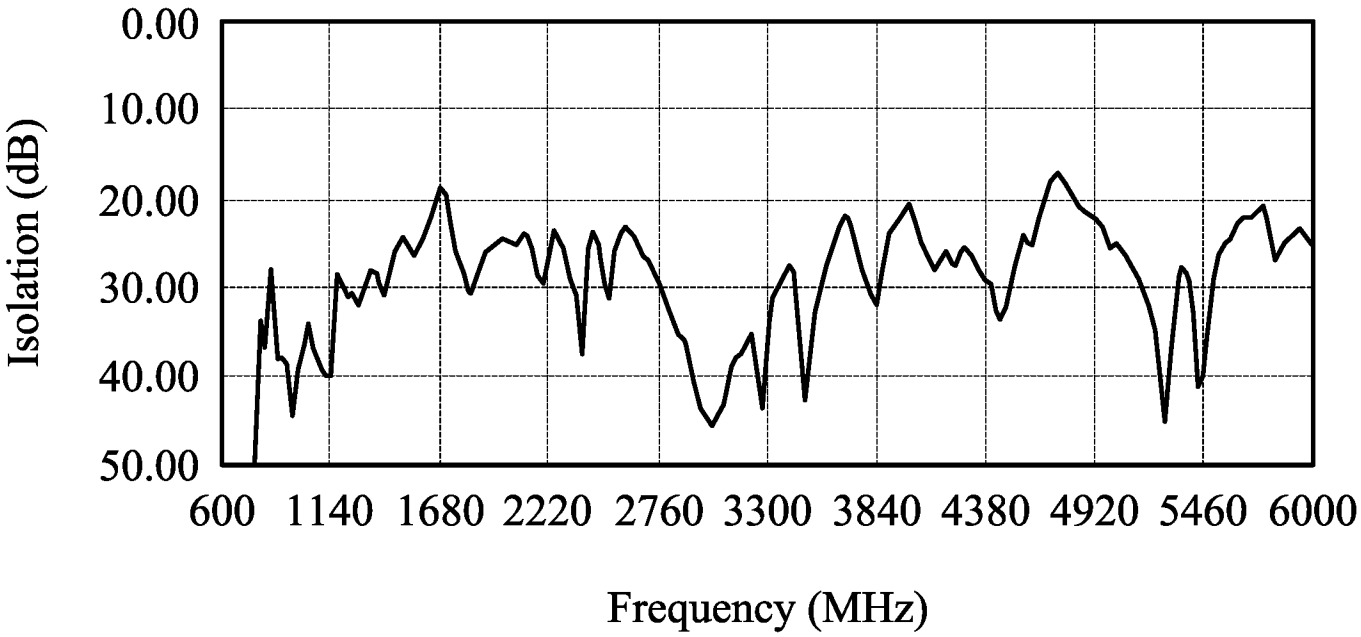
FIG. 3C is a diagram of isolation between a first antenna and a second antenna according to an embodiment of the invention.

FIG. 3A is a diagram of isolation between the first antenna 300 and the third antenna 500 according to an embodiment of the invention. FIG. 3B is a diagram of isolation between the second antenna 400 and the third antenna 500 according to an embodiment of the invention. FIG. 3C is a diagram of isolation between the first antenna 300 and the second antenna 400 according to an embodiment of the invention. According to the measurement of FIG. 3A, FIG. 3B, and FIG. 3C, within the wide operation bandwidth from 600 MHz to 6000 MHz, the isolation between any two of the first antenna 300, the second antenna 400, and the third antenna 500 can be higher than 17 dB (or the corresponding S21 parameter is lower than −17 dB), and it can meet the requirements on the practical application of general antenna systems.

The invention proposes a novel antenna system. By incorporating an antenna having a different frequency into two antennas having the same frequency, the invention not only increases the isolation of the antenna system but also minimizes the total size of the antenna system, and therefore it is suitable for application in a variety of mobile communication devices with small sizes.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-3. The invention may include any one or more features of any one or more embodiments of FIGS. 1-3. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna system, comprising:

a first antenna;

a second antenna; and a third antenna, disposed between the first antenna and the second antenna;

wherein the first antenna and the second antenna operate in a first frequency band covering a first frequency interval and a second frequency interval, wherein the third antenna operates in a second frequency band which is different from the first frequency band, and wherein the first antenna, the second antenna, and the third antenna are disposed on a same plane;

wherein the first antenna comprises:

a first ground plane;

a first feeding connection element, having a first feeding point;

a first radiation element, coupled to the first feeding connection element; and a first shorting element, wherein the first feeding connection element is coupled through the first shorting element to the first ground plane;

wherein the first feeding connection element, the first radiation element, and the first shorting element are excited to generate the first frequency interval, and wherein the first feeding connection element and the first shorting element are excited to generate the second frequency interval.

2. The antenna system as claimed in claim 1, wherein a distance between the first antenna and the third antenna is longer than or equal to 5 mm, and a distance between the second antenna and the third antenna is longer than or equal to 5 mm.

3. The antenna system as claimed in claim 1, wherein the first frequency interval is from 2400 MHz to 2500 MHz and the second frequency interval is from 4800 MHz to 6000 MHz, and wherein the second frequency band covers a third frequency interval from 680 MHz to 960 MHz, a fourth frequency interval from 1700 MHz to 2200 MHz, and a fifth frequency interval from 2500 MHz to 2700 MHz.

4. The antenna system as claimed in claim 3, wherein the second antenna comprises:

a second ground plane;

a second feeding connection element, having a second feeding point;

a second radiation element, coupled to the second feeding connection element; and a second shorting element, wherein the second feeding connection element is coupled through the second shorting element to the second ground plane.

5. The antenna system as claimed in claim 4, wherein the second shorting element is surrounded by the second ground plane, the second feeding connection element, and the second radiation element.

6. The antenna system as claimed in claim 4, wherein a combination of the second feeding connection element and the second radiation element substantially has an inverted U-shape.

7. The antenna system as claimed in claim 4, wherein the second shorting element substantially has an inverted L-shape.

8. The antenna system as claimed in claim 4, wherein the second feeding connection element, the second radiation element, and the second shorting element are excited to generate the first frequency interval, and wherein the second feeding connection element and the second shorting element are excited to generate the second frequency interval.

9. The antenna system as claimed in claim 4, wherein the third antenna comprises:

a third ground plane;

a third feeding connection element, having a third feeding point;

a third radiation element, coupled to the third feeding connection element;

a fourth radiation element, coupled to the third feeding connection element; and a third shorting element, wherein the third feeding connection element is coupled through the third shorting element to the third ground plane.

10. The antenna system as claimed in claim 9, wherein the fourth radiation element is surrounded by the third feeding connection element, the third radiation element, and the third shorting element.

11. The antenna system as claimed in claim 9, wherein the fourth radiation element further comprises a terminal rectangular widening portion.

12. The antenna system as claimed in claim 9, wherein the third radiation element substantially has an inverted U-shape.

13. The antenna system as claimed in claim 9, wherein the third shorting element substantially has an inverted U-shape.

14. The antenna system as claimed in claim 9, wherein the third feeding connection element, the third radiation element, and the third shorting element are excited to generate the third frequency interval, wherein the third feeding connection element, the fourth radiation element, and the third shorting element are excited to generate the fourth frequency interval, and wherein the third feeding connection element and the third shorting element are excited to generate the fifth frequency interval.

15. The antenna system as claimed in claim 1, wherein the first shorting element is surrounded by the first ground plane, the first feeding connection element, and the first radiation element.

16. The antenna system as claimed in claim 1, wherein a combination of the first feeding connection element and the first radiation element substantially has an inverted U-shape.

17. The antenna system as claimed in claim 1, wherein the first shorting element substantially has an inverted L-shape.

* * * * *